US008016550B2

(12) United States Patent
Lin

(10) Patent No.: US 8,016,550 B2
(45) Date of Patent: Sep. 13, 2011

(54) DIRECTION-SWITCHABLE PNEUMATIC CYLINDER

(75) Inventor: Freddy Lin, Taichung Hsien (TW)

(73) Assignee: Gison Machinery Co., Ltd., Taichung Hsien (TW)

( * ) Notice: Subject to any disclaimer, the term of this patent is extended or adjusted under 35 U.S.C. 154(b) by 1046 days.

(21) Appl. No.: 11/849,274

(22) Filed: Sep. 1, 2007

(65) Prior Publication Data

US 2009/0060713 A1 Mar. 5, 2009

(51) Int. Cl.
*F01D 1/30* (2006.01)

(52) U.S. Cl. ..... 415/153.2; 415/152.1; 415/904

(58) Field of Classification Search ..... 415/22, 415/80, 82, 152.1, 153.1, 153.2, 154.1, 199.1, 415/193, 199.4, 199.5, 904, 911; 416/198 A, 416/198 R, 199, 200 R
See application file for complete search history.

(56) References Cited

U.S. PATENT DOCUMENTS 2,414,638 A * 1/1947 Dobie ..... 418/1
3,386,702 A * 6/1968 Krzyszczuk ..... 415/123
3,942,392 A * 3/1976 Page et al. ..... 433/129
7,040,414 B1 * 5/2006 Kuo ..... 173/179

OTHER PUBLICATIONS

U.S. Appl. No. 11/324,383, filed Jan. 4, 2006, Freddy Lin.

* cited by examiner

*Primary Examiner* — Nathaniel Wiehe
(74) *Attorney, Agent, or Firm* — Ming Chow; Sinorica, LLC

(57) ABSTRACT

A direction-switchable pneumatic cylinder includes: a cylinder body with two intakes, several exhaustion ports and a rotary shaft; and a predetermined number of movable wheels and fixed wheels arranged in the cylinder body and interlaced with each other. Each of the movable wheels and fixed wheels is formed with several vents concentrically arranged into an inner circle and an outer circle. The rotary shaft is fitted through the movable wheels and fixed wheels. The fixed wheels are not rotatable, while the movable wheels are synchronously rotatably with the rotary shaft. The outer circles of vents of the fixed wheels and the movable wheels are aligned with one intake, while the inner circles of vents of the fixed wheels and the movable wheels are aligned with the other intake. When high-pressure gas is guided into the pneumatic cylinder from one intake, the airflow will flow through the outer circles of vents to drive the movable wheels and the rotary shaft in one direction. When high-pressure gas is guided into the pneumatic cylinder from the other intake, the airflow will flow through the inner circles of vents to drive the movable wheels and the rotary shaft in another direction.

20 Claims, 13 Drawing Sheets

DIRECTION-SWITCHABLE PNEUMATIC CYLINDER

BACKGROUND OF THE INVENTION

The present invention is related to a pneumatic tool, and more particularly to a pneumatic cylinder which can switch the rotational direction between forward rotation and backward rotation.

It is known that some pneumatic tools such as pneumatic wrenches and pneumatic screwdrivers can be operated in forward direction or backward direction. Under such circumstance, the pneumatic cylinder must be operable in both directions.

The conventional pneumatic cylinder which can be operated in both directions is an eccentric rotor. Such pneumatic cylinder has a left half and a right half which are symmetrical to each other. When high-pressure gas goes into from the right half, the pneumatic cylinder is clockwise operated. Reversely, when high-pressure gas goes into from the left half, the pneumatic cylinder is driven to counterclockwise operate.

Said conventional pneumatic has been used for decades. It is tried by the inventor to provide a novel pneumatic cylinder.

SUMMARY OF THE INVENTION

It is therefore a primary object of the present invention to provide a pneumatic cylinder the rotational direction of which can be switched between forward direction and backward direction.

The present invention can be best understood through the following description and accompanying drawings wherein:

DETAILED DESCRIPTION OF THE PREFERRED EMBODIMENTS

Figure 1:
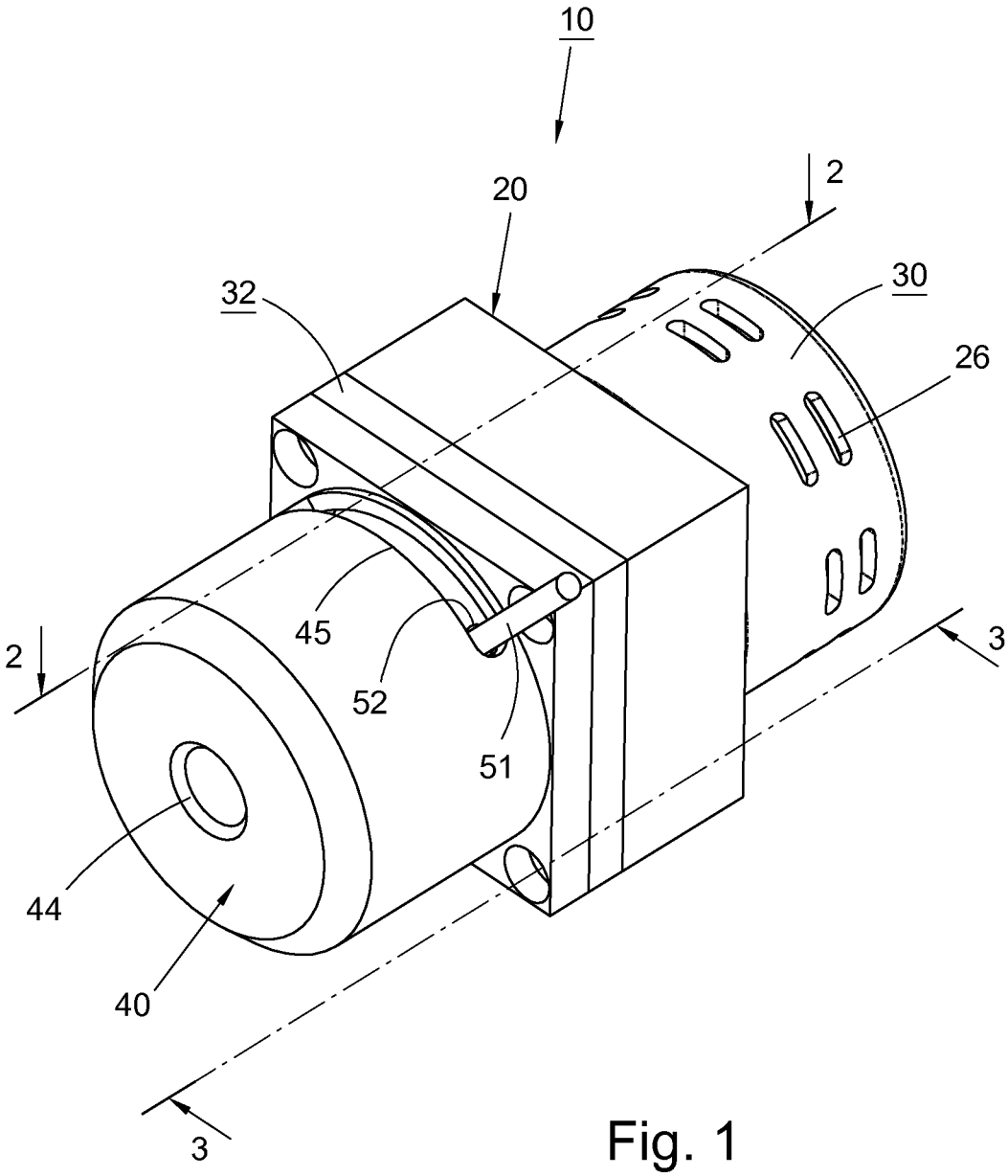
FIG. 1 is a perspective view of a first embodiment of the present invention.
Figure 2:
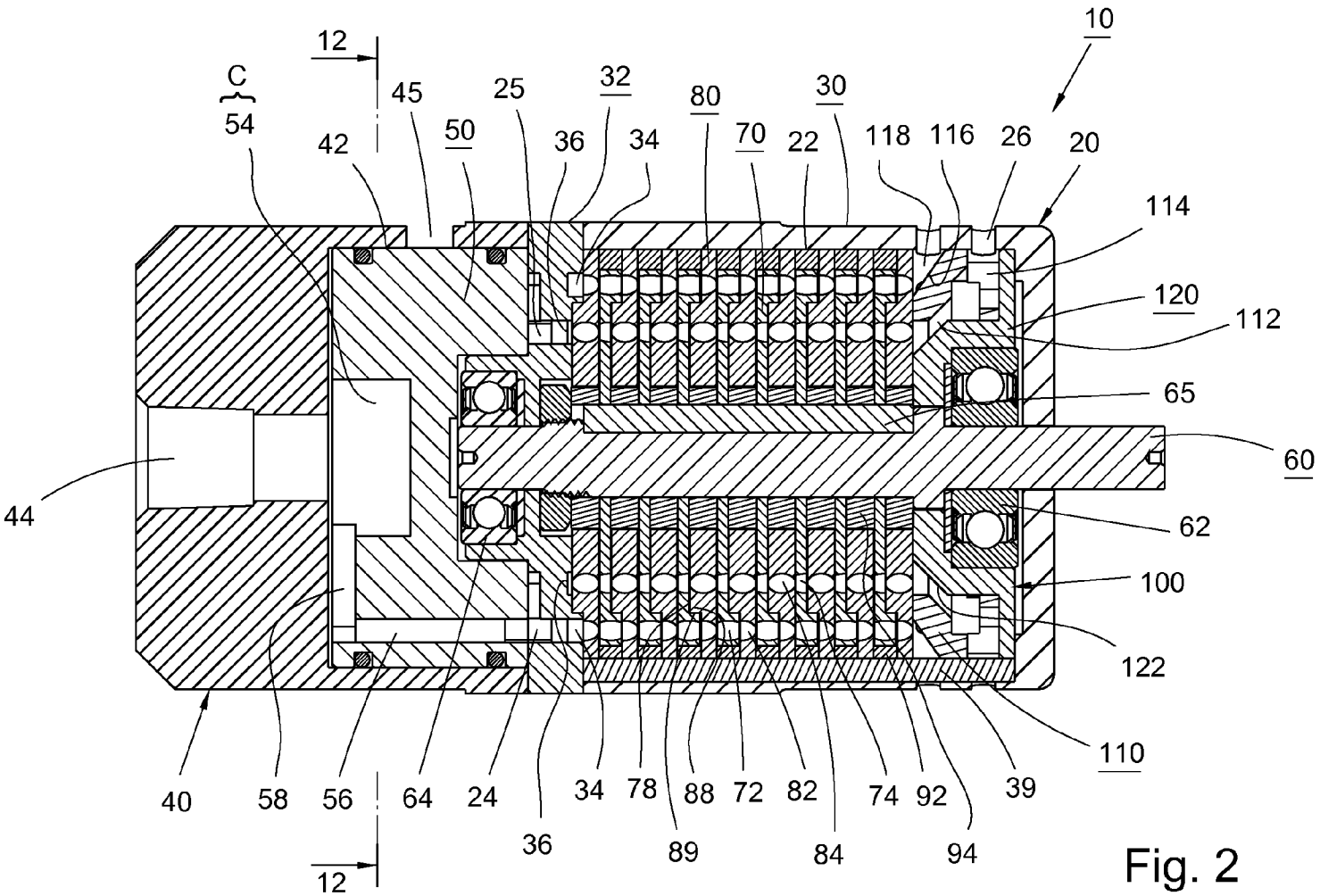
FIG. 2 is a sectional view taken along line 2-2 of FIG. 1.
Figure 3:
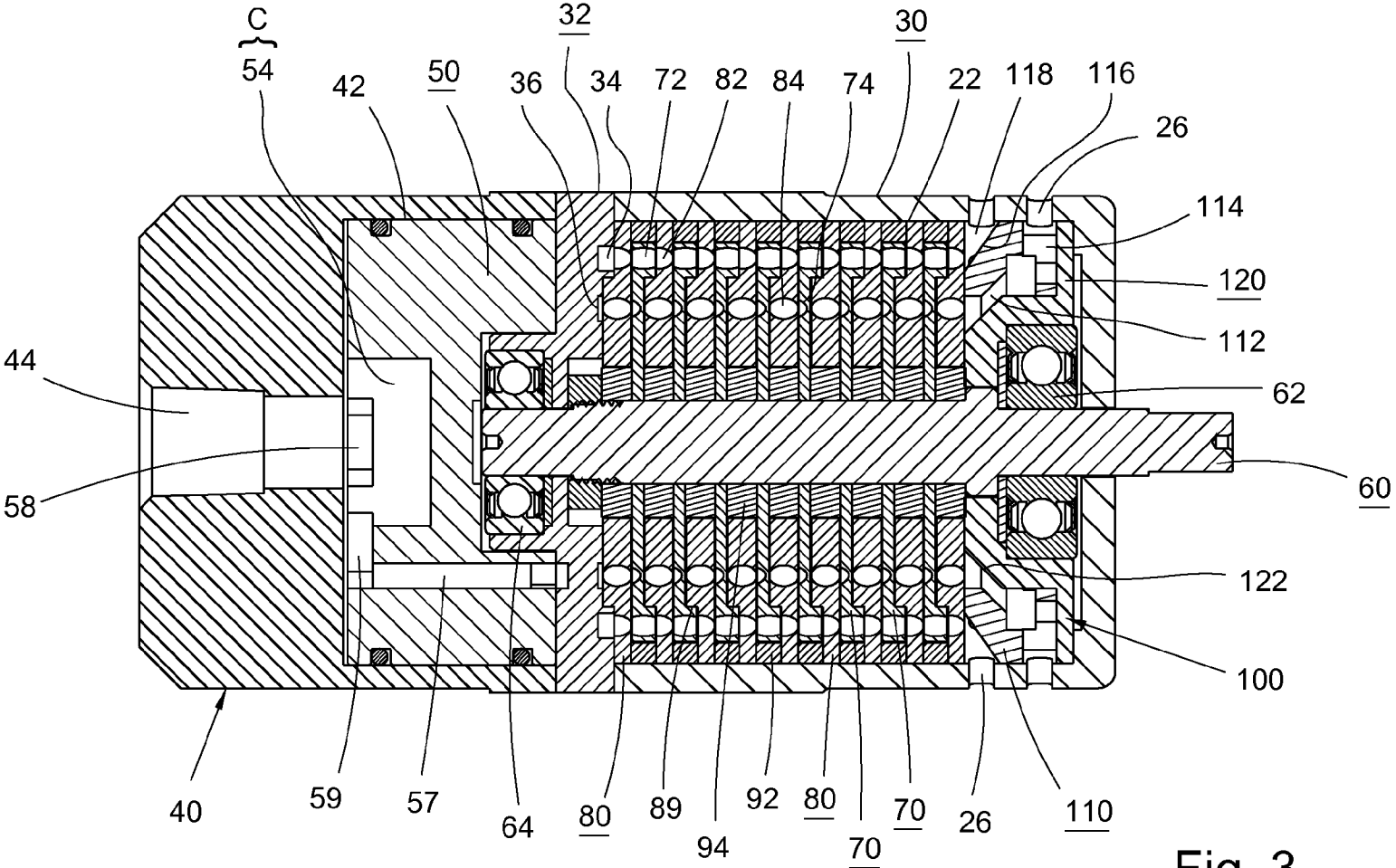
FIG. 3 is a sectional view taken along line 3-3 of FIG. 1.

Please refer to FIGS. 1 to 3. According to a first embodiment, the pneumatic cylinder 10 of the present invention includes a cylinder body 20, multiple movable wheels 70 and multiple fixed wheels 80. The movable wheels 70 and fixed wheels 80 are arranged in the cylinder body 20 and interlaced with each other. The movable wheels 80 are movable along with a rotary shaft 60.

The cylinder body 20 has a cylinder chamber 22 formed in the cylinder body. Two intakes 24, 25 are formed on a front end of the cylinder body to communicate with the cylinder chamber 22. At least one exhaustion port 26 is formed on a rear end of the cylinder body to communicate with the cylinder chamber 22.

Figure 4:
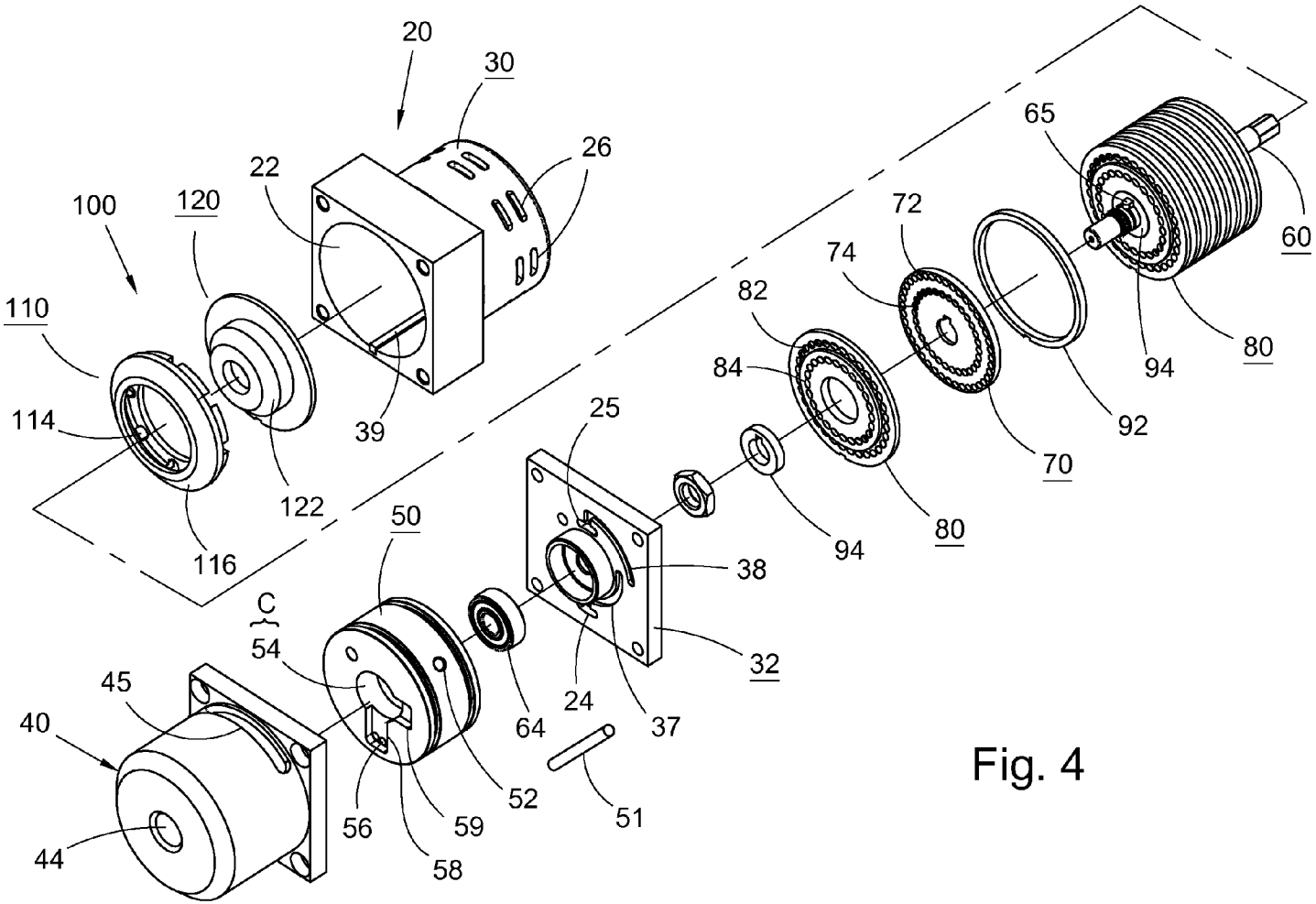
FIG. 4 is a front perspective exploded view according to FIG. 1.
Figure 5:
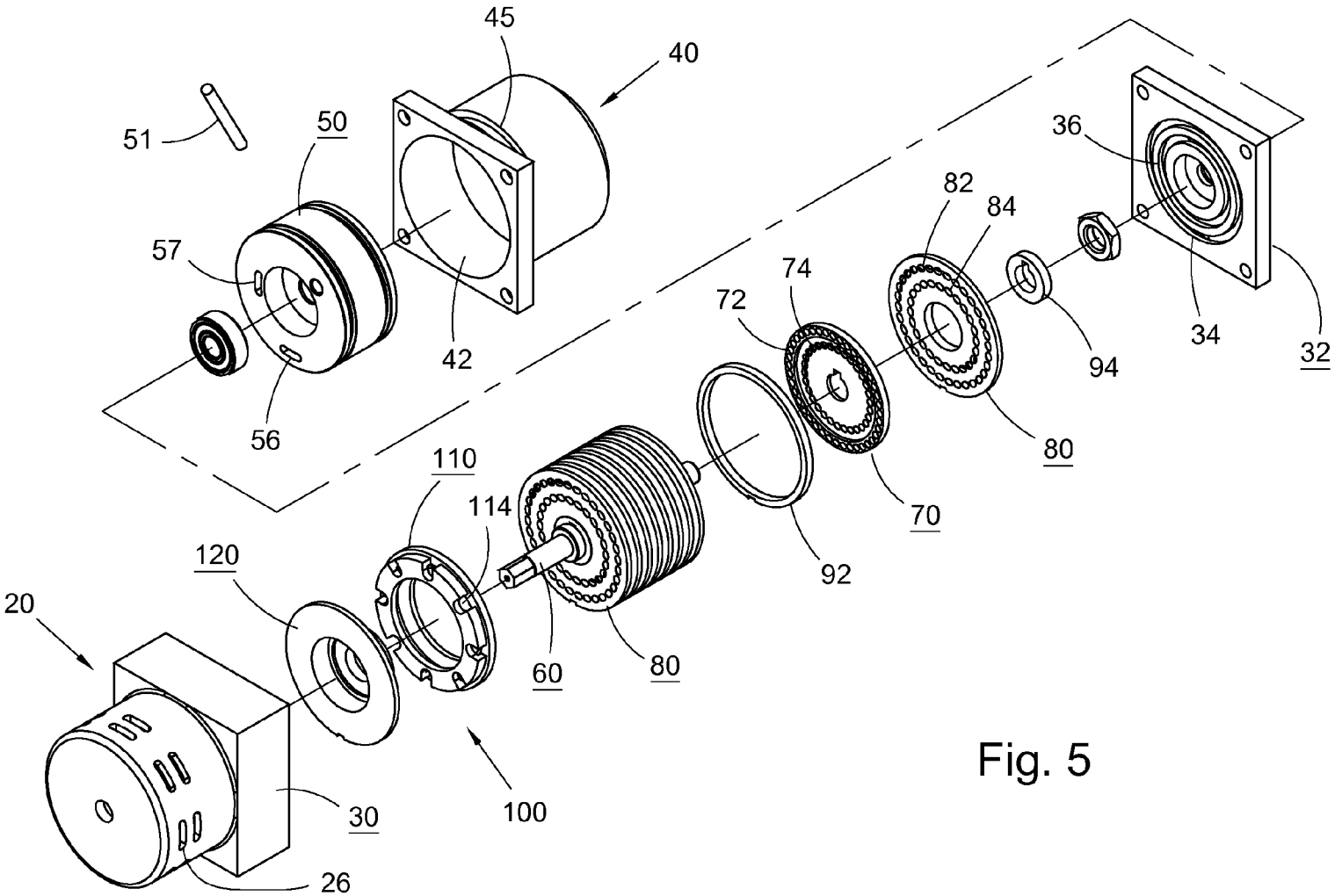
FIG. 5 is a rear perspective exploded view according to FIG. 1.
Figure 6A:
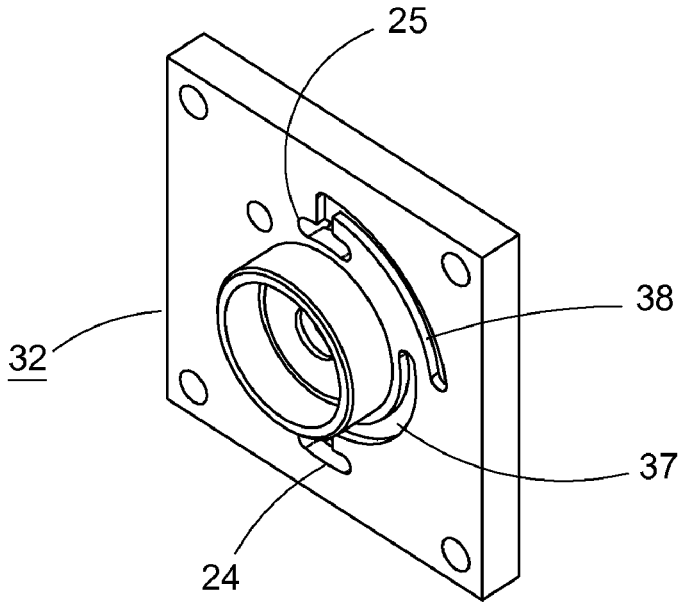
FIGS. 6A and 6B are respectively front perspective view and front view of the cylinder cap of the first embodiment of the present invention.
Figure 6B:
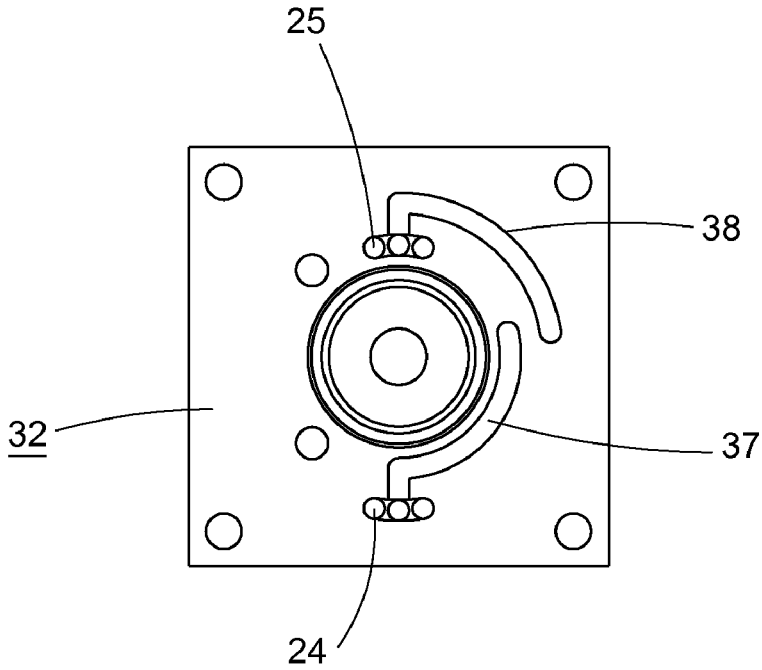
Figure 7A:
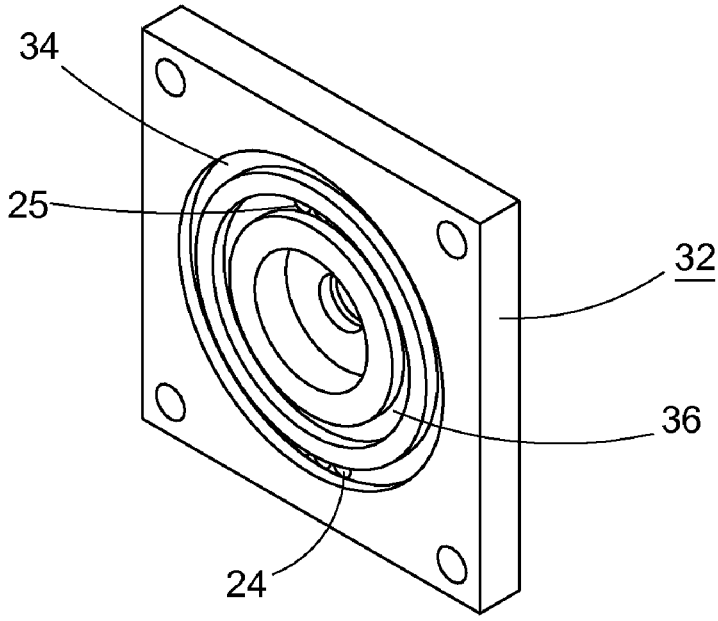
FIGS. 7A and 7B are respectively rear perspective view and rear view of the cylinder cap of the first embodiment of the present invention.
Figure 7B:
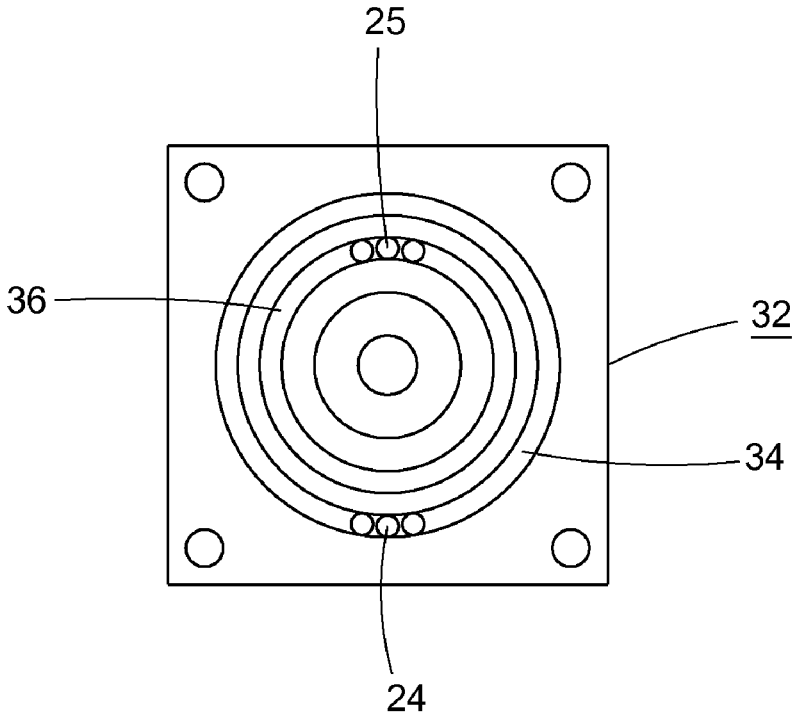
Figure 8A:
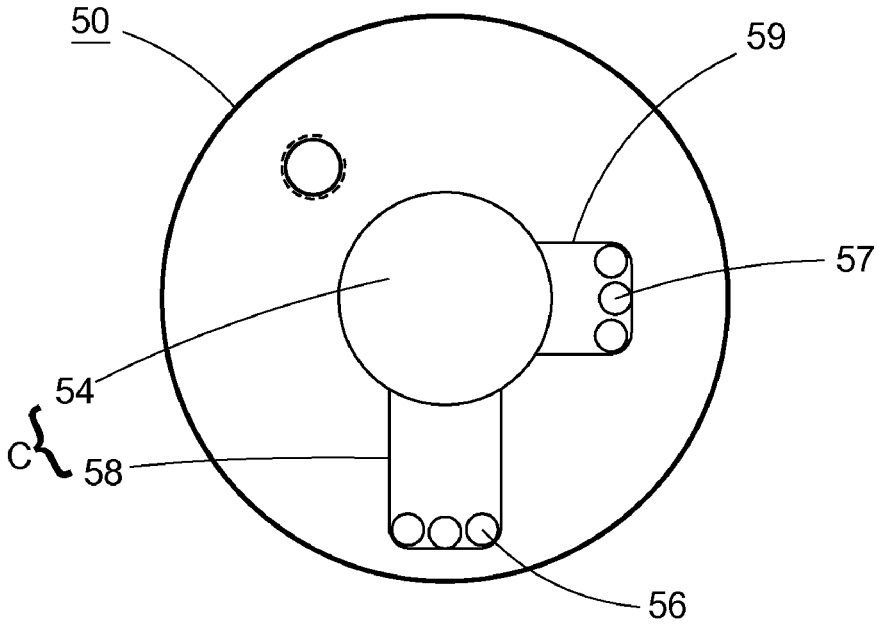
FIGS. 8A and 8B are respectively front view and rear view of the switch button of the first embodiment of the present invention.
Figure 8B:
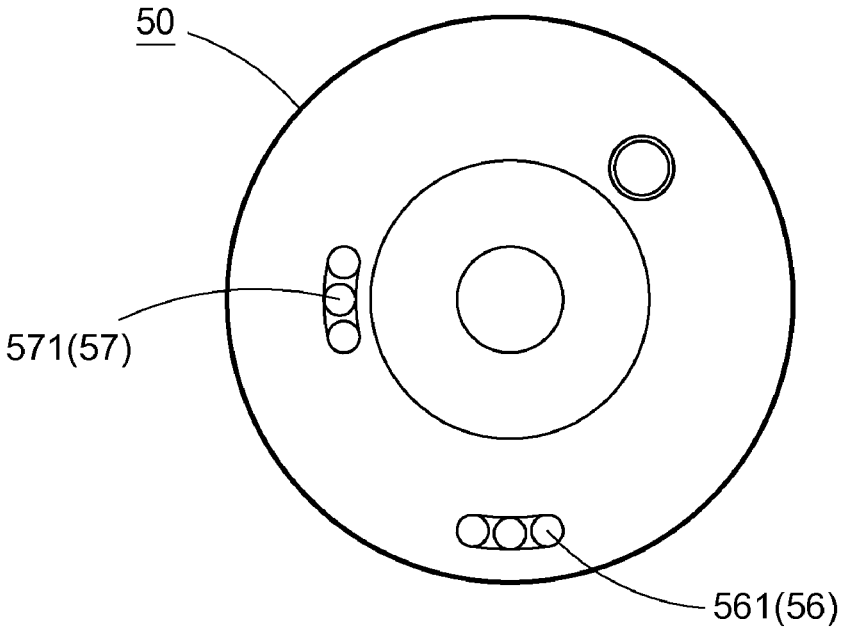

More detailedly, referring to FIGS. 4 and 5, the cylinder body 20 has a body section 30 and a cylinder cap 32 covering a front end of the body section 30. The cylinder chamber 22 is formed in the body section 30 and inward extends from the front end of the body section. Said intakes 24, 25 are formed on the cylinder cap 32 at intervals. (In this embodiment, each intake is composed of three orifices which are side by side arranged.) Referring to FIGS. 6A to 7B, two annular gas channels 34, 36 are concentrically formed on a rear face of the cylinder cap 32. The outer gas channel 34 communicates with the first intake 24, while the inner gas channel 36 communicates with the second intake 25. Preferably, the distance between the first intake 24 and the center of the cylinder cap 32 is unequal to the distance between the second intake 25 and the center of the cylinder cap 32.

A switch seat 40, a rear end face of the switch seat 40 is inward recessed to form a cavity 42. A gas inlet 44 is formed on a front end face of the switch seat 40 to communicate with the cavity 42. A rear end of the switch seat 40 is fixedly connected with the front end of the cylinder body 20. The circumference of the switch seat 40 is formed with an arced slot 45.

A switch button 50 which is airtight rotatably installed in the cavity 42 of the switch seat 40. The circumference of the switch button 50 is formed with an insertion hole 52. A controlling member 51 which is a pin member in this embodiment is passed through the arced slot 45 of the switch seat 40 and inserted in the insertion hole 52 of the switch button 50. Accordingly, when shifting the controlling member 51, the switch button 50 can be switched between positions. The switch button 50 has at least one gas conduit C. Two ends of the gas conduit C are respectively positioned on a front end face and a rear end face of the switch button. Referring to FIGS. 4, 5, 8A and 8B, in this embodiment, a depression 54 is formed on the front end face of the switch button. Two through holes 56, 57 are formed through the switch button from the front end face to the rear end face thereof and spaced from each other by a certain distance. (In this embodiment, each through hole is composed of three orifices which are side by side arranged.) Two recesses 58, 59 are formed on the front end face of the switch button. Two ends of the first recess 58 respectively communicate with the depression 54 and the through hole 56. Two ends of the second recess 59 respectively communicate with the depression 54 and the other through hole 57. The depression 54 serves as the front end of the gas conduit C, while the rear ends 561, 571 of the through holes serve as the rear end of the gas conduit C. In practice, only one through hole is necessary to form the rear end of the gas conduit on the rear end face of the switch button. Referring to FIGS. 2 and 3, the front end of the gas conduit C, that is, the depression 54, is connected to the gas inlet 44. The rear end of the gas conduit C, that is, 561 and 571, corresponds to the two intakes 24, 25.

The rotary shaft 60 is mounted in the cylinder body 20. Two ends of the rotary shaft 60 are fitted in two bearings 62, 64 which are respectively mounted on the body section 30 and the cylinder cap 32.

The numbers of said movable wheels 70 and fixed wheels 80 can be changed in accordance with the output power necessary for the pneumatic cylinder. For example, in case of greater power, more movable wheels and fixed wheels can be arranged. Reversely, in case of less power, fewer movable wheels and fixed wheels are mounted.

Figure 9A:
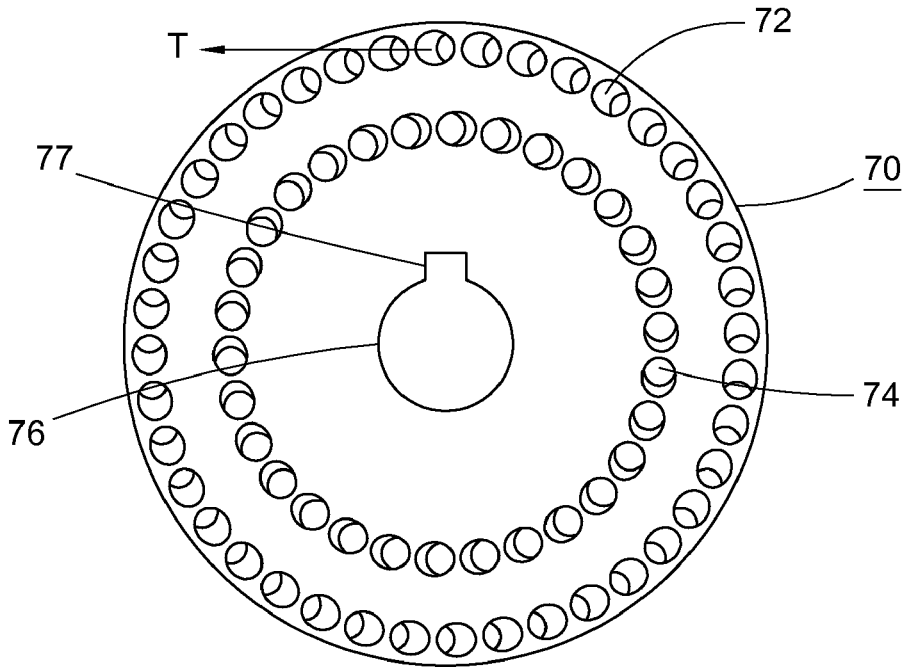
FIGS. 9A and 9B are respectively front view and rear perspective view of the movable wheel of the first embodiment of the present invention.
Figure 9B:
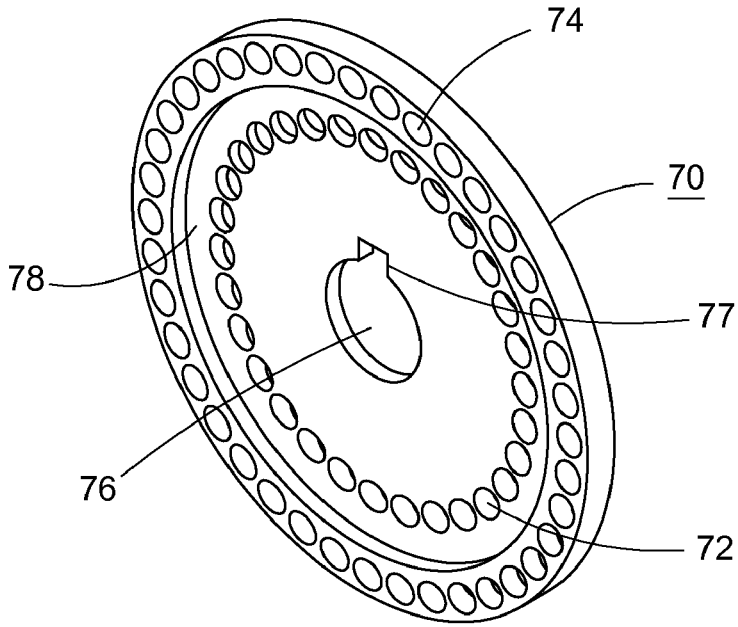

Referring to FIGS. 9A and 9B, each movable wheel 70 is formed with several outer and inner vents 72, 74 concentrically arranged into an inner circle and an outer circle at equal intervals. The direction of the axis of the vent 74 of the inner circle is different from the direction of the axis of the vent 72 of the outer circle and is preferably reverse to the direction of the axis of the vent 72 of the outer circle. With FIG. 9A exemplified, in the tangent direction T, the vent 72 of the outer circle is rightward inclined from a front end to a rear end, while the vent 74 of the inner circle is leftward inclined from a front end to a rear end. The movable wheels 70 are mounted in the cylinder chamber 22 with the rotary shaft 60 fitted through the central shaft holes 76 of the movable wheels. The rotary shaft 60 has a spline 65 inserted in the spline notches 77 of the movable wheels 70, whereby the movable wheels 70 are synchronously rotatable with the rotary shaft.

Figure 10A:
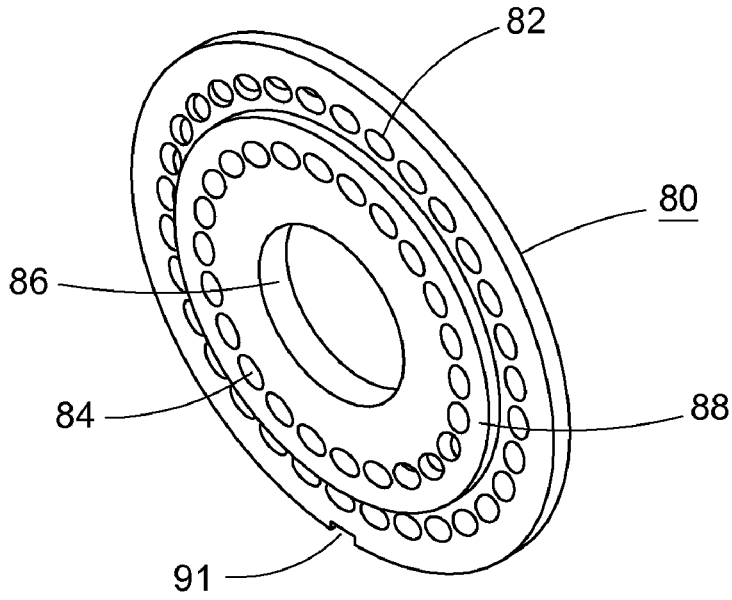
FIGS. 10A and 10B are respectively front perspective view and rear view of the fixed wheel of the first embodiment of the present invention.
Figure 10B:
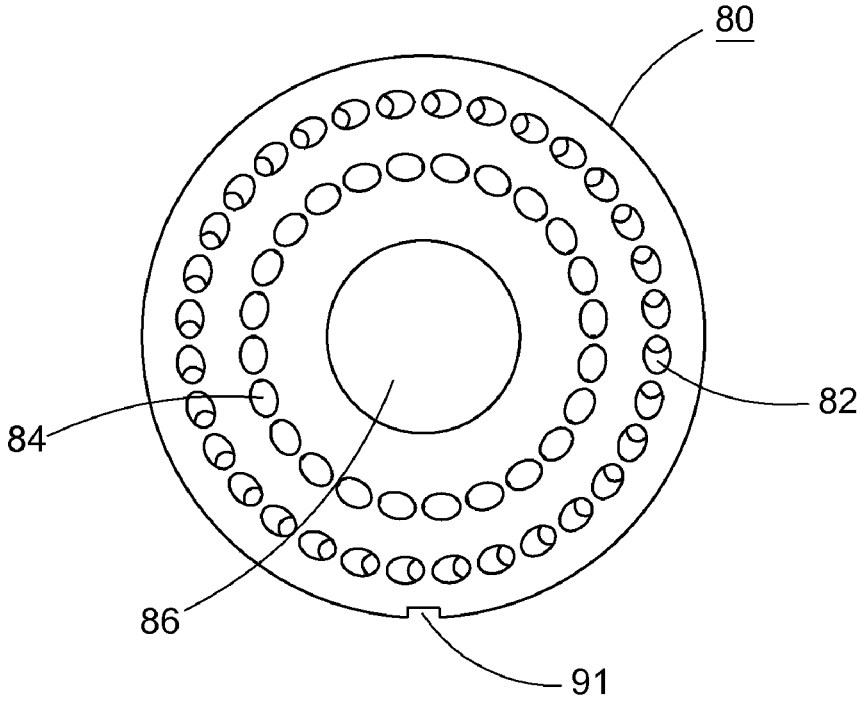
Figure 11:
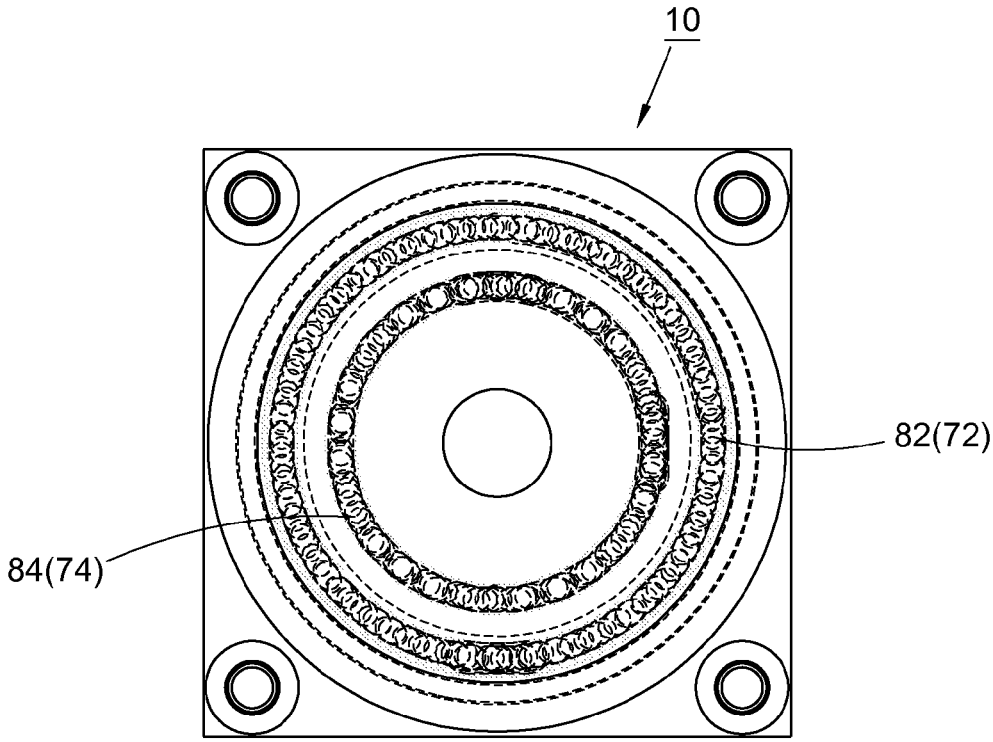
FIG. 11 is a front view according to FIG. 1.

Referring to FIGS. 10A and 10B, each fixed wheel 80 is also formed with several outer and inner vents 82, 84 concentrically arranged into an inner circle and an outer circle at equal intervals. The direction of the axis of the vent 84 of the inner circle is different from the direction of the axis of the vent 82 of the outer circle and is preferably reverse to the direction of the axis of the vent 82 of the outer circle. In addition, the direction of the axis of the vent 82 of the outer circle of the fixed wheel 80 is also different from (preferably reverse to) the direction of the axis of the vent 72 of the outer circle of the movable wheel 70. The direction of the axis of the vent 84 of the inner circle of the fixed wheel 80 is also different from the direction of the axis of the vent 74 of the inner circle of the movable wheel 70. The fixed wheels 80 are fixedly mounted in the cylinder chamber 22 at equal intervals without possibility of rotation, and are interlaced with the movable wheels 70. The rotary shaft 60 is passed through the through holes 86 of the fixed wheels. Referring to FIGS. 2 and 11, the outer circles of vents 72, 82 of the movable wheels and fixed wheels are aligned with each other for the airflow to pass through. The outer circles of vents 72, 82 are right positioned behind the outer annular gas channel 34 in alignment with the gas channel 34. Similarly, the inner circle of vents 74 coincides with the inner circle of vents 84 and the vents 74 are aligned with the vents 84. The inner circles of vents 74, 84 are right positioned behind the inner annular gas channel 36 in alignment with the gas channel 36. In addition, as shown in FIG. 9B, each movable wheel 70 has a rear end face formed with a circular recess 78. The circumference of the circular recess 78 is positioned between the inner and outer circles of vents. Each fixed wheel 80 has a front end face formed with a circular boss 88 adapted to the circular recess 78 of the movable wheel as shown in FIG. 10A. The boss 88 can be fitted in the recess 78 of the movable wheel, whereby the mating face between the boss 88 and the recess 78 is defined as an annular isolating shoulder face 89 as shown in FIG. 2. Accordingly, the airflow going through the outer circles of vents 72, 82 is isolated from the airflow going through the inner circles of vents 74, 84 without mixing therewith.

Furthermore, referring to FIGS. 2 and 4, a locating pin 39 is disposed on the wall of the cylinder chamber 22. The circumference of each fixed wheel 80 is formed with a notch 91. The locating pin 39 is inlaid in the notches 91 to prevent the fixed wheels 80 from rotating. Several outer spacer rings 92 are mounted in the cylinder chamber 22 at intervals. Each outer spacer ring 92 has a thickness slightly larger than the thickness of the movable wheel 70, and has an inner diameter slightly larger than the outer diameter of the movable wheel. The movable wheels 70 are respectively received in the spacer rings 92. Two end faces of each outer spacer ring 92 are respectively leaned on two adjacent fixed wheels 80. Accordingly, the gap between two adjacent fixed wheels is larger than the thickness of the movable wheel, whereby when rotating, the movable wheels will not rub against the fixed wheels. The present invention further includes several inner spacer rings 94. Each inner spacer ring 94 has an outer diameter smaller than the diameter of the through hole 86 of the fixed wheel. The inner spacer rings 94 are fitted on the rotary shaft 60 at intervals and respectively positioned in the through holes 86 of the fixed wheels 80. The inner spacer rings 94 are synchronously rotatable with the rotary shaft and the movable wheels. The inner spacer ring 94 has a thickness slightly larger than the thickness of the fixed wheel. Two end faces of each inner spacer ring 94 are respectively leaned on two adjacent movable wheels 70. Accordingly, the gap between two adjacent movable wheels 70 is larger than the thickness of the fixed wheel. Therefore, similarly, when rotating, the movable wheels will not contact the fixed wheels. Accordingly, when the pneumatic cylinder operates, the movable wheels will not abrade the fixed wheels.

Referring to FIGS. 2 to 5, an exhaustion assembly 100 has an outer ring 110 and an inner ring 120 fitted in the outer ring 110. The outer ring 110 and inner ring 120 define therebetween an annular space 112. Several through holes 114 are formed through the outer ring 110 at equal intervals from an outer circumference of the outer ring 110 to an inner circumference thereof to communicate with the annular space 112. The outer circumference of a front end of the outer ring 110 is a truncated conic face 116. The outer circumference of a front end of the inner ring 120 is an inner truncated conic face. The exhaustion assembly 100 is mounted in the cylinder chamber 22 right behind the movable and fixed wheels. The truncated conic face 116 of the outer ring and the inner wall of the body section 30 define therebetween another annular space 118. The inner annular space 112 is right aligned with the inner circle of vents 84 of the fixed wheel 80, while the outer annular space 118 is aligned with the outer circle of vents 82 of the fixed wheel. Accordingly, the exhaustion assembly provides two independent exhaustion spaces for the inner circles of vents 74, 84 and the outer circles of vents 72, 82 to exhaust the gas.

The pneumatic cylinder 10 of the present invention is installable in a pneumatic tool. The pneumatic cylinder 10 is operable in different directions.

Figure 12:
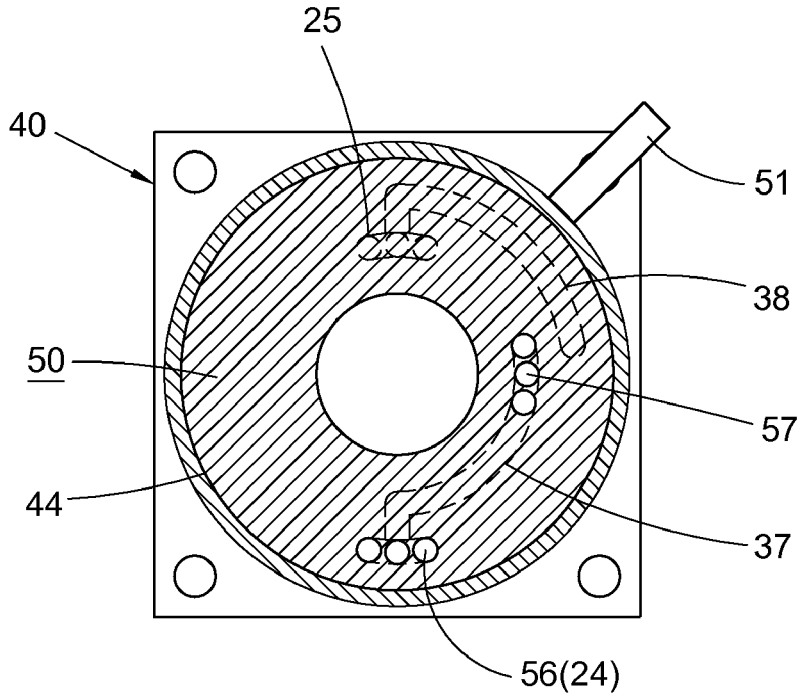
FIG. 12 is a sectional view taken along line 12-12 of FIG. 2, showing that the gas is guided into the pneumatic cylinder from an intake.

Referring to FIGS. 2 and 12, in use, the controlling member 51 is shifted to switch the switch button 50 to the position as shown in FIGS. 1 and 12. At this time, the rear end of the gas conduit C of the switch button, that is, the rear ends of the through holes 56, 57, communicates with the first intake 24 of the cylinder body. The through hole 56 directly communicates with the first intake 24, while the through hole 57 communicates with the first intake via a first guide slot 37. Therefore, the two through holes 56, 57 both communicate with the first intake 24.

The high-pressure gas flows into the gas conduit C of the switch button 50 from the gas inlet 44 of the switch seat 40. The high-pressure gas flows through the depression 54 to be guided by the two recesses 58, 59 to flow into the two through holes 56, 57. The high-pressure gas then goes into the first intake 24 of the cylinder body 20 to fill up the outer annular gas channel 34. The high-pressure gas then goes along the axis of the cylinder body to sequentially flow through the outer circles of vents 82, 72 of the fixed wheels 80 and the movable wheels 70.

The gas flowing out from the outer circles of vents 82 of each fixed wheels 80 is an inclined airflow. The inclined airflow flows into the outer circles of vents 72 of the movable wheel 70 behind the fixed wheel. The vents 72 of the movable wheel are directed in a direction different from the direction of the vents 82 of the fixed wheel. Therefore, after the airflow flows into the vents 72 of the movable wheel 70, the movable wheel 70 is driven and rotated. At this time, the rotary shaft 60 is rotated along with the movable wheel. According to the direction of FIG. 11, the movable wheels and the rotary shaft are counterclockwise rotated.

When the gas sequentially flows through the movable wheels 70 and fixed wheels 80, the airflow obliquely flows in different directions, whereby the movable wheels are driven and rotated. The rotational kinetic energy of the movable wheels is summed up. When the pneumatic cylinder operates, all the movable wheels are synchronously rotated. Accordingly, the rotational kinetic energy of the rearward movable wheel is fed back to the forward movable wheel.

After the high-pressure gas flows through the outer circles of vents of all the movable wheels and the fixed wheels, the high-pressure gas further flows to the exhaustion assembly 110 and flows through the outer annular space 118 to be exhausted from the pneumatic cylinder through several exhaustion ports 26 thereof.

Figure 13:
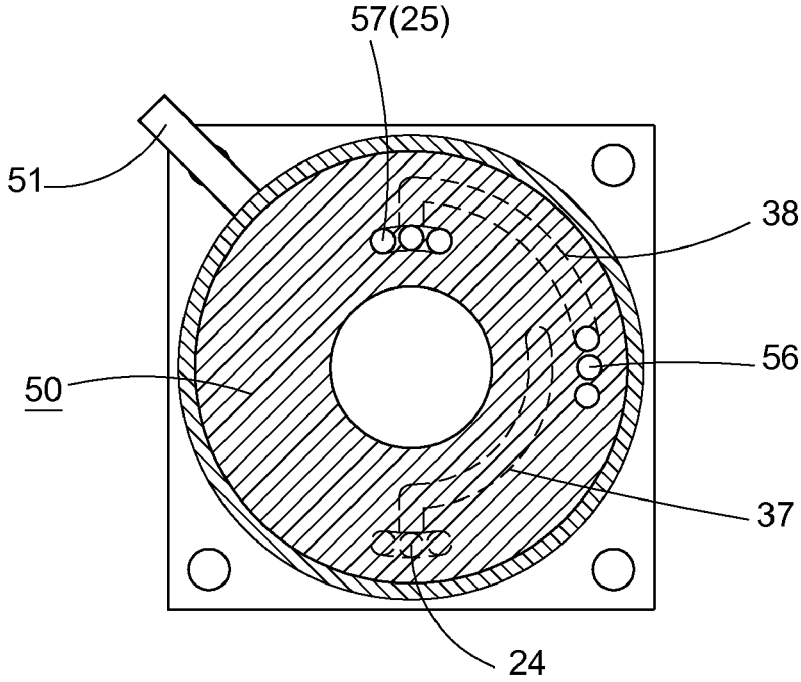
FIG. 13 is a sectional view according to FIG. 12, showing that the gas is guided into the pneumatic cylinder from the other intake.

When changing the rotational direction of the pneumatic cylinder, the switch button 50 is switched to the position as shown in FIG. 13. At this time, the rear end of the gas conduit C of the switch button, that is, the rear ends of the through holes 56, 57, communicates with the second intake 25 of the cylinder body. The through hole 57 directly communicates with the second intake 25, while the through hole 56 communicates with the second intake via a second guide slot 38. Therefore, the two through holes 56, 57 both communicate with the second intake 25.

The high-pressure gas flows from the gas inlet 44 of the switch seat 40 into the gas conduit C of the switch button 50. Then the high-pressure gas flows into the second intake 25 of the cylinder body 20 to fill up the inner annular gas channel 36. The high-pressure gas then sequentially flows through the inner circles of vents 84, 74 of the fixed wheels 80 and the movable wheels 70.

The gas flowing out from the inner circles of vents 84 of the fixed wheels 80 is an inclined airflow. The inclined airflow flows into the inner circles of vents 74 of the movable wheels 70 behind the fixed wheels. At this time, the movable wheels 70 are driven and rotated and the rotary shaft 60 is rotated along with the movable wheels. As the direction of the axis of the inner vent 84 of the movable wheel is reverse to the direction of the axis of the outer vent 82, therefore, according to the direction of FIG. 11, the movable wheels and the rotary shaft are clockwise rotated.

After the high-pressure gas flows through the inner circles of vents of all the movable wheels and the fixed wheels, the high-pressure gas further flows through the inner annular space 112 of the exhaustion assembly 110 to be exhausted from the pneumatic cylinder through several exhaustion ports 26 thereof.

According to the above arrangement, the pneumatic cylinder of the present invention is capable of changing operation directions. In this embodiment, the rotational direction of the pneumatic cylinder is changeable only switch the switch button between two positions.

Figure 14:
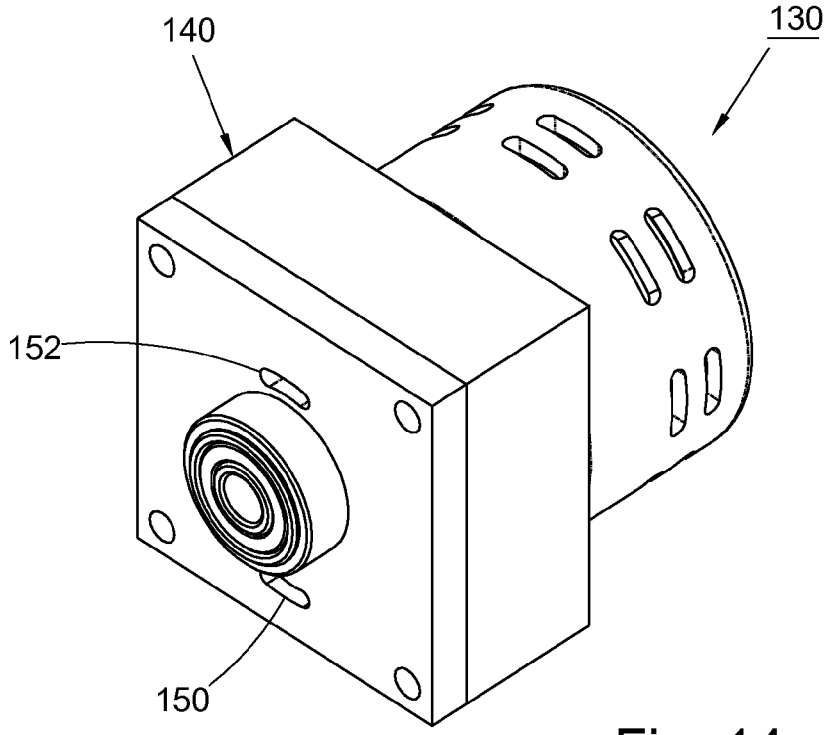
FIG. 14 is a perspective view of a second embodiment of the present invention.
Figure 15:
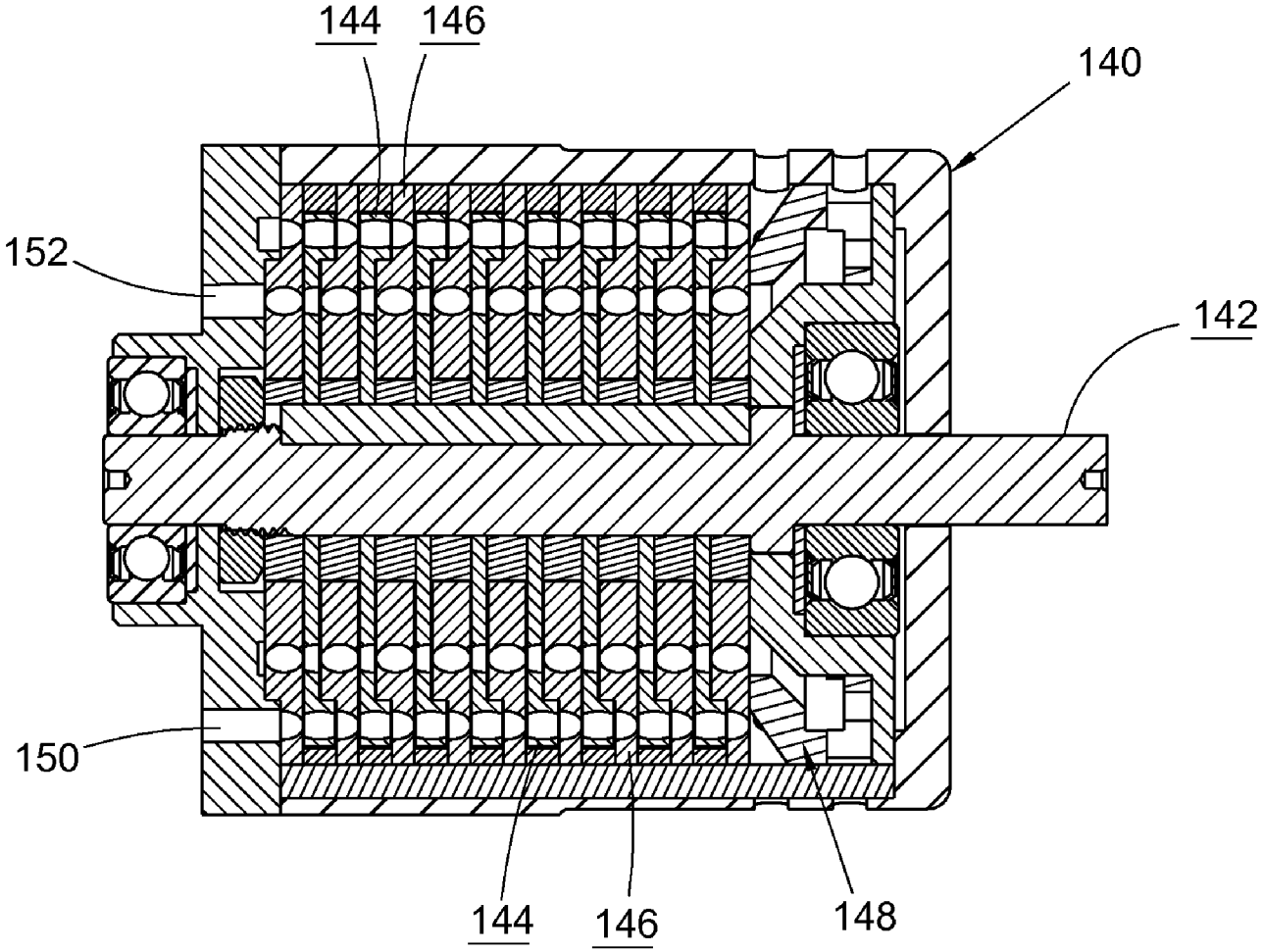
FIG. 15 is a longitudinal sectional view according to FIG. 14.

FIGS. 14 and 15 are perspective and sectional views of another embodiment of the pneumatic cylinder 130 of the present invention.

In this embodiment, the pneumatic cylinder also includes a cylinder body 140, a rotary shaft 142, multiple movable wheels 144, multiple fixed wheels 146 and an exhaustion assembly 148. These components are all arranged in the cylinder body 20 and identical to those of the first embodiment.

Two flow ways are disposed in the main body of the pneumatic tool to respectively communicate with the two intakes 150, 152 of the pneumatic cylinder 130. The gas is controllable to flow into the pneumatic cylinder from different intakes so that the rotational direction of the pneumatic cylinder is changeable. In this embodiment, the switch button and switch seat of the first embodiment are omitted.

The pneumatic cylinder of the present invention itself has a direction-changing design. In addition, the numbers of the movable wheels and fixed wheels can be increased or decreased to change the output power of the pneumatic cylinder.

The rotational kinetic energy applied to the movable wheels by the outer circle of airflow is greater than the rotational kinetic energy applied by the inner circle of airflow. Therefore, in the case that the outer circle of airflow is used to drive the pneumatic cylinder for unscrewing a screw, it can be ensured that the screw is effectively unscrewed. The conventional pneumatic cylinder lacks such effect.

In operation, the movable wheels will not abrade the wall of the cylinder body and the fixed wheels so that the frictional resistance is low. Accordingly, the loss of power can be minimized and the pneumatic cylinder can operate at higher speed.

The above embodiments are only used to illustrate the present invention, not intended to limit the scope thereof. Many modifications of the above embodiments can be made without departing from the spirit of the present invention.

What is claimed is:

1. A direction-switchable pneumatic cylinder comprising:

a cylinder body having an internal cylinder chamber; a first and a second intakes being formed on a front end of the cylinder body; several exhaustion ports being formed on a rear end of the cylinder body;

a switch seat fixed connected with the front end of the cylinder body; a cavity being formed in the switch seat; a gas inlet being formed on the switch seat to communicate with the cavity;

a switch button airtight movably mounted in the cavity of the switch seat; a controlling member being connected with the switch button for driving the switch button to move between two positions; at least one gas conduit being formed on the switch button, the gas conduit having a rear end corresponding to the two intakes, whereby when the switch button is switched to one of the two positions, the rear end of the gas conduit communicates with the first intake, while when the switch button is switched to the other position, the rear end of the gas conduit communicates with the second intake;

a rotary shaft rotatably arranged in the cylinder body; and a predetermined number of movable wheels and fixed wheels, each the movable wheel being formed with several vents concentrically arranged into an inner circle and an outer circle, a direction of the axis of the vent of the inner circle being different from a direction of the axis of the vent of the outer circle; each the fixed wheel being formed with several vents concentrically arranged into an inner circle and an outer circle, a direction of the axis of the vent of the inner circle of the fixed wheel being different from a direction of the axis of the vent of the outer circle of the fixed wheel; the direction of the axis of the vent of the outer circle of the fixed wheel being different from the direction of the axis of the vent of the outer circle of the movable wheel; the direction of the axis of the vent of the inner circle of the fixed wheel being different from the direction of the axis of the vent of the inner circle of the movable wheel; the fixed wheels and the movable wheels being arranged in the cylinder chamber along the axis of the pneumatic cylinder and interlaced with each other; the rotary shaft being fitted through the fixed wheels and movable wheels; the fixed wheels being fixedly mounted in the cylinder chamber without rotation; the movable wheels being fitted around the rotary shaft and synchronously rotatable therewith; the vents of outer circles of the fixed wheels and the movable wheels being aligned with each other and communicating with the first intake; the vents of inner circles of the fixed wheels and the movable wheels being aligned with each other and communicating with the second intake.

2. The pneumatic cylinder as claimed in claim 1, wherein an outer annular gas channel and an inner annular gas channels are concentrically formed on an inner face of the front end of the cylinder body, the outer gas channel communicates with the first intake and is aligned with the outer circles of vents of the movable wheels and fixed wheels; the inner gas channel communicates with the second intake and is aligned with the inner circles of vents of the movable wheels and fixed wheels.

3. The pneumatic cylinder as claimed in claim 2, wherein the cylinder body has a body section and a cylinder cap covering a front end of the body section; the cylinder chamber being formed in the body section and inward extending from the front end of the body section; the two intakes being formed on the cylinder cap; the outer and inner annular gas channels being concentrically formed on an inner face of the cylinder cap, the exhaustion ports being formed on a rear end of the body section.

4. The pneumatic cylinder as claimed in claim 1, wherein each movable wheel has a rear end face formed with a circular recess, an circumference of the circular recess being positioned between the inner and outer circles of vents of the movable wheel; each fixed wheel having a front end face formed with a circular boss, an circumference of the circular boss being positioned between the inner and outer circles of vents of the fixed wheel, the boss of the fixed wheel being fitted in the recess of the movable wheel and a mating face between the boss and the recess forms an annular isolating shoulder face.

5. The pneumatic cylinder as claimed in claim 1, wherein a circumference of the switch seat is formed with a slot communicating with the cavity; a controlling member being passed through the slot to connect with the switch button, whereby by means of shifting the controlling member, the switch button is driven and moved.

6. The pneumatic cylinder as claimed in claim 5, wherein a depression is formed on the front end face of the switch button; at least one through hole being formed through the switch button from the front end face to the rear end face thereof; at least one recess being formed on the front end face of the switch button to communicate with the depression and a front end of the through hole, the depression serving as the front end of the gas conduit, while a rear end of the through hole serving as the rear end of the gas conduit.

7. The pneumatic cylinder as claimed in claim 1, further comprising an exhaustion assembly disposed in the cylinder chamber behind the fixed wheels and movable wheels, the exhaustion assembly being formed with an inner annular space and an outer annular space, the inner annular space corresponding to the inner circle of vents, while the outer annular space corresponding to the outer circles of vents.

8. The pneumatic cylinder as claimed in claim 7, wherein the exhaustion assembly includes an outer ring and an inner ring fitted in the outer ring to define the inner annular space; several through holes being formed through the outer ring at intervals from an outer circumference of the outer ring to an inner circumference thereof to communicate with the inner annular space; the outer circumference of a front end of the outer ring and a wall of the cylinder chamber defining therebetween the outer annular space.

9. The pneumatic cylinder as claimed in claim 8, wherein the outer circumference of the front end of the outer ring is a truncated conic face and an outer circumference of a front end of the inner ring is also a truncated conic face.

10. The pneumatic cylinder as claimed in claim 1, further comprising several outer spacer rings and inner spacer rings, each outer spacer ring having a thickness slightly larger than the thickness of the movable wheel, the outer spacer ring having an inner diameter slightly larger than the outer diameter of the movable wheel, the outer spacer rings being arranged in the cylinder chamber, two end faces of each outer spacer ring being respectively leaned on two adjacent fixed wheels; the movable wheels being respectively received in the outer spacer rings; each inner spacer ring having an outer diameter smaller than the diameter of a central through hole of the fixed wheel, the inner spacer ring having a thickness slightly larger than the thickness of the fixed wheel, the inner spacer rings being fitted on the rotary shaft and respectively positioned in the central through holes of the fixed wheels, whereby the inner spacer rings are synchronously rotatable with the rotary shaft and the movable wheels, two end faces of each inner spacer ring being respectively leaned on two adjacent movable wheels.

11. A direction-switchable pneumatic cylinder comprising:

a cylinder body having an internal cylinder chamber; a first and a second intakes being formed on a front end of the cylinder body; several exhaustion ports being formed on a rear end of the cylinder body;

a rotary shaft rotatably arranged in the cylinder body; and a predetermined number of movable wheels and fixed wheels;

each the movable wheel being formed with several vents concentrically arranged into an inner circle and an outer circle, a direction of the axis of the vent of the inner circle being different from a direction of the axis of the vent of the outer circle;

each the fixed wheel being formed with several vents concentrically arranged into an inner circle and an outer circle, a direction of the axis of the vent of the inner circle of the fixed wheel being different from a direction of the axis of the vent of the outer circle of the fixed wheel; the direction of the axis of the vent of the outer circle of the fixed wheel being different from the direction of the axis of the vent of the outer circle of the movable wheel; the direction of the axis of the vent of the inner circle of the fixed wheel being different from the direction of the axis of the vent of the inner circle of the movable wheel; the fixed wheels and the movable wheels being arranged in the cylinder chamber along the axis of the pneumatic cylinder and interlaced with each other; the rotary shaft being fitted through the fixed wheels and movable wheels; the fixed wheels being fixedly mounted in the cylinder chamber without rotation; the movable wheels being fitted around the rotary shaft and synchronously rotatable therewith; the vents of outer circles of the fixed wheels and the movable wheels being aligned with each other and communicating with the first intake; the vents of inner circles of the fixed wheels and the movable wheels being aligned with each other and communicating with the second intake.

12. The pneumatic cylinder as claimed in claim 11, wherein an outer annular gas channel and an inner annular gas channels are concentrically formed on an inner face of the front end of the cylinder body, the outer gas channel communicates with the first intake and is aligned with the outer circles of vents of the movable wheels and fixed wheels; the inner gas channel communicates with the second intake and is aligned with the inner circles of vents of the movable wheels and fixed wheels.

13. The pneumatic cylinder as claimed in claim 12, wherein the cylinder body has a body section and a cylinder cap covering a front end of the body section; the cylinder chamber being formed in the body section and inward extending from the front end of the body section; the two intakes being formed on the cylinder cap; the outer and inner annular gas channels being concentrically formed on an inner face of the cylinder cap, the exhaustion ports being formed on a rear end of the body section.

14. The pneumatic cylinder as claimed in claim 11, wherein each movable wheel has a rear end face formed with a circular recess, an circumference of the circular recess being positioned between the inner and outer circles of vents of the movable wheel; each fixed wheel having a front end face formed with a circular boss, an circumference of the circular boss being positioned between the inner and outer circles of vents of the fixed wheel, the boss of the fixed wheel being fitted in the recess of the movable wheel and a mating face between the boss and the recess forms an annular isolating shoulder face.

15. The pneumatic cylinder as claimed in claim 11, further comprising an exhaustion assembly disposed in the cylinder chamber behind the fixed wheels and movable wheels, the exhaustion assembly being formed with an inner annular space and an outer annular space, the inner annular space corresponding to the inner circle of vents, while the outer annular space corresponding to the outer circles of vents.

16. The pneumatic cylinder as claimed in claim 15, wherein the exhaustion assembly includes an outer ring and an inner ring fitted in the outer ring to define the inner annular space; several through holes being formed through the outer ring at intervals from an outer circumference of the outer ring to an inner circumference thereof to communicate with the inner annular space; the outer circumference of a front end of the outer ring and a wall of the cylinder chamber defining therebetween the outer annular space.

17. The pneumatic cylinder as claimed in claim 16, wherein the outer circumference of the front end of the outer ring is a truncated conic face and an outer circumference of a front end of the inner ring is also a truncated conic face.

18. The pneumatic cylinder as claimed in claim 11, further comprising several outer spacer rings and inner spacer rings, each outer spacer ring having a thickness slightly larger than the thickness of the movable wheel, the outer spacer ring having an inner diameter slightly larger than the outer diameter of the movable wheel, the outer spacer rings being arranged in the cylinder chamber, two end faces of each outer spacer ring being respectively leaned on two adjacent fixed wheels; the movable wheels being respectively received in the outer spacer rings; each inner spacer ring having an outer diameter smaller than the diameter of a central through hole of the fixed wheel, the inner spacer ring having a thickness slightly larger than the thickness of the fixed wheel, the inner spacer rings being fitted on the rotary shaft and respectively positioned in the central through holes of the fixed wheels, whereby the inner spacer rings are synchronously rotatable with the rotary shaft and the movable wheels, two end faces of each inner spacer ring being respectively leaned on two adjacent movable wheels.

19. The pneumatic cylinder as claimed in claim 11, wherein the movable wheels and fixed wheels are disc-shaped and the vents are formed on the movable wheels and fixed wheels by drilling.

20. The pneumatic cylinder as claimed in claim 11, wherein the direction of the axis of the vent of the inner circle of each the movable wheel and the direction of the axis of the vent of the outer circle of each the fixed wheel are the same directions; the direction of the axis of the vent of the outer circle of each the movable wheel and the direction of the axis of the vent of the inner circle of each the fixed wheel are the same directions.

* * * * *